US008223996B2

(12) United States Patent
Beekman et al.

(10) Patent No.: US 8,223,996 B2
(45) Date of Patent: Jul. 17, 2012

(54) MOVING ARMATURE RECEIVER

(75) Inventors: Niels Beekman, Hilversum (NL); Dennis Jacobus Mattheus Mocking, Utrecht (NL); Peter Madaffari, Camden, ME (US)

(73) Assignee: Sonion Nederland B.V., Amsterdam (NL)

( * ) Notice: Subject to any disclaimer, the term of this patent is extended or adjusted under 35 U.S.C. 154(b) by 1077 days.

(21) Appl. No.: 12/070,473

(22) Filed: Feb. 19, 2008

(65) Prior Publication Data

US 2008/0226115 A1 Sep. 18, 2008

Related U.S. Application Data

(60) Provisional application No. 60/902,573, filed on Feb. 20, 2007.

(51) Int. Cl.
*H04R 25/00* (2006.01)

(52) U.S. Cl. ..... 381/152

(58) Field of Classification Search ..... 381/152
See application file for complete search history.

(56) References Cited

U.S. PATENT DOCUMENTS

| | | | | |
|---|---|---|---|---|
| 4,956,868 | A | 9/1990 | Carlson | |
| 6,788,794 | B2 * | 9/2004 | Corsaro et al. | 381/152 |
| 7,054,460 | B2 * | 5/2006 | Rombach et al. | 381/421 |
| 2005/0276433 | A1 | 12/2005 | Miller et al. | |
| 2008/0101641 | A1 * | 5/2008 | Miles | 381/355 |

FOREIGN PATENT DOCUMENTS

| | | |
|---|---|---|
| GB | 1357403 | 9/1971 |
| GB | 1348745 | 5/1972 |
| JP | 2005-236844 | 9/2005 |
| WO | WO9507014 A1 | 3/1995 |
| WO | WO0060902 A1 | 10/2000 |
| WO | WO02102112 | 12/2002 |
| WO | WO2004064483 A2 | 8/2004 |

OTHER PUBLICATIONS

European Patent Office Standard Search Report (Nov. 1, 2007) (4 pages).

* cited by examiner

*Primary Examiner* — Charles Garber
*Assistant Examiner* — Andre' C Stevenson
(74) *Attorney, Agent, or Firm* — Nixon Peabody LLP

(57) ABSTRACT

A compact moving armature receiver where the diaphragm element is positioned in the air gap of the magnet assembly and where a suspension element is provided for defining the front chamber, the suspension element has a stiffness of at the most 500 N/m. The suspension element and the diaphragm element may be made from the same sheet of a foil, and the suspension element may be formed by bent or curved peripheral parts of the foil.

13 Claims, 4 Drawing Sheets

MOVING ARMATURE RECEIVER

CROSS-REFERENCE TO RELATED APPLICATION

This application claims the benefit of the U.S. Provisional Application 60/902,573, filed on Feb. 20, 2007, entitled "A Moving Armature Receiver" and is hereby incorporated by reference in its entirety.

FIELD OF THE INVENTION

The present invention relates to moving armature receivers in which an armature is provided in the magnetic field of one or more magnets and thus is vibrated due to an electrical signal being introduced into a coil, the field of which affects the armature. In particular, the present invention relates to compact moving armature receivers.

BACKGROUND OF THE INVENTION

Different types of receivers may be seen in WO 2004/064483, WO 95/07014, U.S. Pat. No. 7,054,460, and US 2005/0276433. One type of suspension is shown in WO 00/60902.

SUMMARY OF THE INVENTION

In a first aspect, the invention relates to a receiver comprising a housing having therein a permanent magnet assembly generating a magnetic field in an air gap, an electrically conductive drive coil comprising a coil tunnel, a sound output, a magnetically permeable armature assembly extending in a first direction through the air gap and the coil tunnel, a suspension element having a stiffness of at the most 500 N/m, and a diaphragm element for producing sound, extending in the air gap, and being operatively attached to the suspension element. The housing has a first and a second chamber defined at least by opposite sides of the diaphragm element and the suspension element. The sound output extends between the first chamber and the surroundings of the receiver.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

In the following, preferred embodiments of the invention will be described with reference to the drawing, wherein.

DETAILED DESCRIPTION OF THE DRAWINGS

Figure 1:
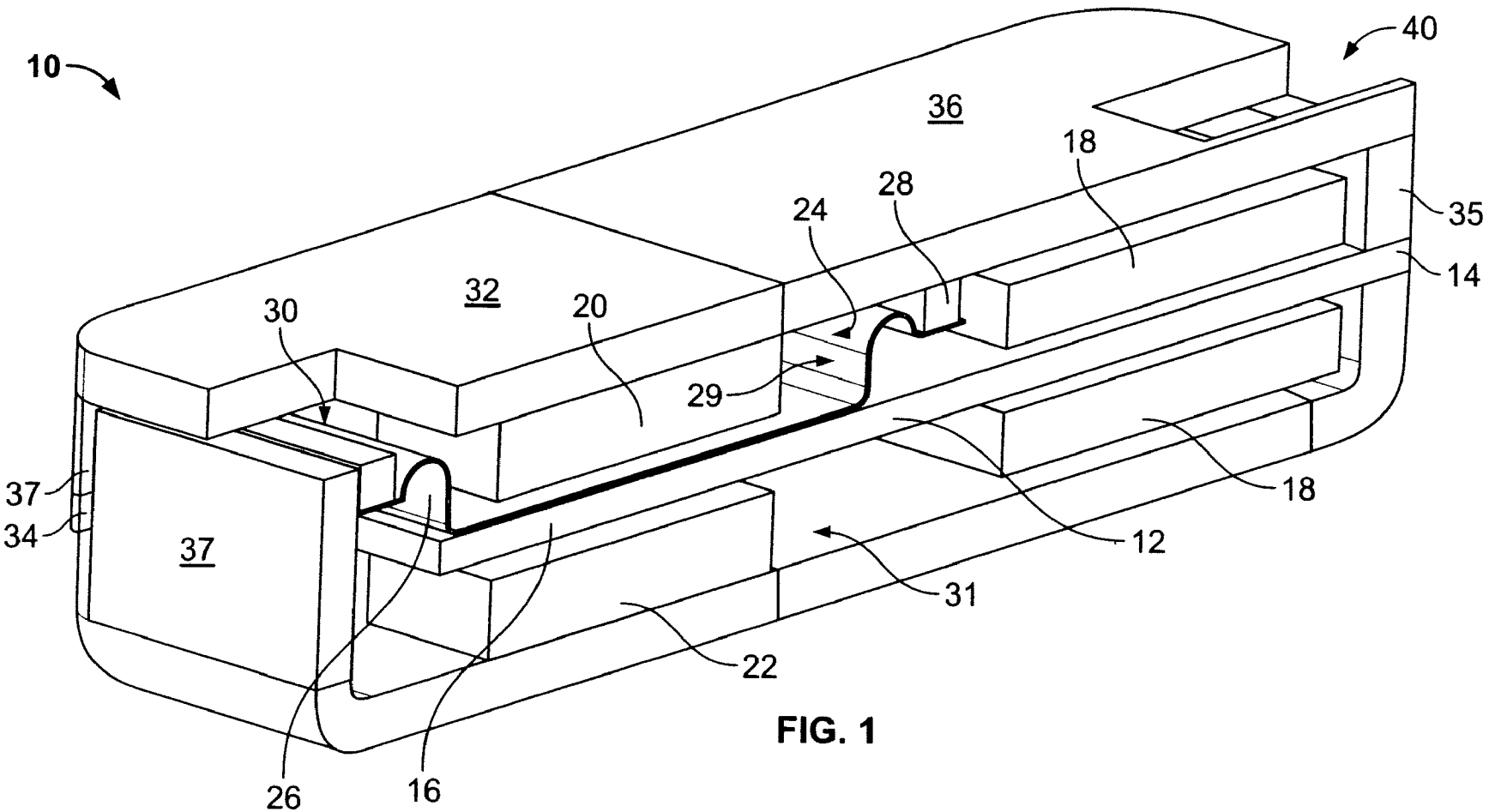
FIG. 1 illustrates a cross section through a receiver according to the invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated and/or described herein.

The receiver 10 of FIG. 1 has a moving armature or armature assembly 12 fixed at one end 14 thereof relative to a housing. The other end, 16, of the armature 12 is movable.

The armature 12 is moved by an AC flux generated by a coil 18 (due to an AC current provided therein via an opening 40) surrounding a part of the armature 12, which AC flux enters a DC flux generated by two magnets 20 and 22. Due to these fluxes, the armature 12 carrying the AC flux will move toward and away from the individual magnets 20, 22.

Attached to the armature 12 at the moving end 16 is a diaphragm 24 which together with the armature 12 forms a magnetically permeable diaphragm assembly, and which has bent or resilient side portions 26 engaging a sealing member 28 which seals a space 29 above the diaphragm 24 from a space 31 below the diaphragm 24. The spaces 29 and 31 normally are called the front chamber and the back chamber of the receiver 10 and will be referred to hereinafter as chambers for convenience.

Due to the resilient side portions 26, which form a suspension element, the diaphragm 24 may be moved up and down by the armature 12 while maintaining the sealing against the member 28 so that an acoustic sealing is maintained. As is usual in this type of receiver 10, a DC vent may exist between the chambers 29, 31.

Alternatively, the member 28 may be resilient so as to provide the deformability desired in order to maintain the sealing of the two chambers 29, 31 from each other.

Areas 32 and 34 are also provided in the housing. The operation of these parts will be described further below.

Figure 2:
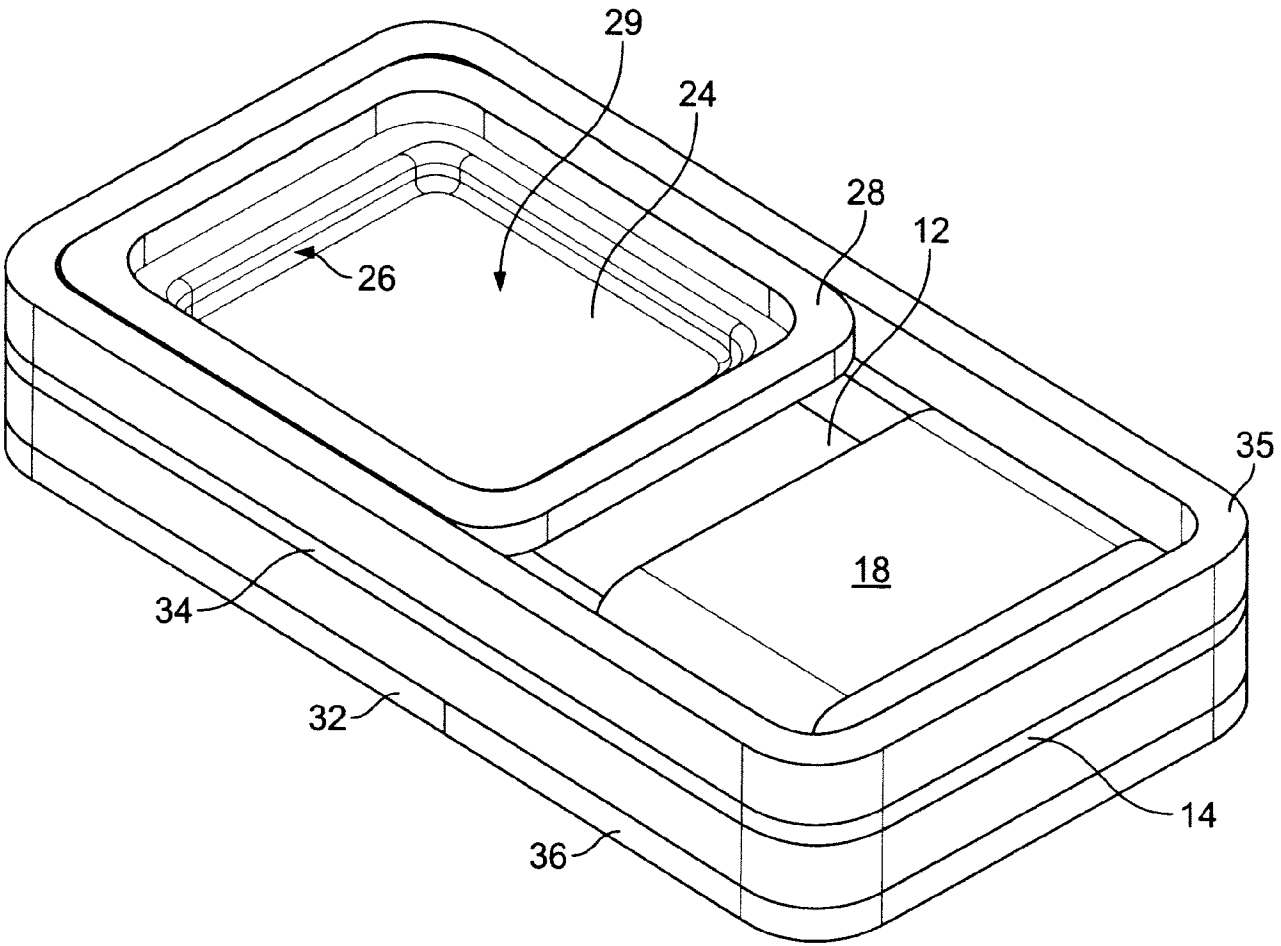
FIG. 2 illustrates a first sub-assembly of the receiver of FIG. 1.

FIG. 2 illustrates a sub-assembly of the receiver 10, wherein the upper housing portions 32 and 36 are not mounted, so that the coil 18, the diaphragm 24 and the sealing member 28 are visible. It is seen that the sealing member 28 is adapted to seal both with the longitudinal inner side portions (part 37) of the receiver 10 as well as the end surface and the top portion 36 when mounted. Naturally, it is not required to seal both toward the side portions and the top portion. From FIG. 1, it is seen that the sound output 30 extends sufficiently far from the output end to provide an opening into the chamber 29 defined by the upper side of the diaphragm 28.

The sound pressure generated by the moving diaphragm 24 is output from the housing via the sound output 30 provided therein.

In order for the receiver 10 to function optimally, it is desired that, for example, the DC flux generated by the permanent magnets 20, 22 is as strong as possible in the air gap therebetween, whereby it is desired that a magnetically permeable flux return path between the permanent magnets 20, 22 outside the air gap is provided. Thus, it is desired that the housing portions 32, to which the permanent magnets 20, 22 are attached, are magnetically permeable or conductive, and that housing portions interconnecting these, such as upper housing portions 34 (positioned symmetrically in the receiver 10), described further below, also are magnetically permeable.

In this manner, the flux path from the air gap is through one of the permanent magnets 20, 22, the upper housing portion 32, the housing portion 34, the lower housing portion 32, the other one of the permanent magnets 20, 22, and to the air gap. This flux path is normally denoted the DC flux path in that it is generated by permanent magnets 20, 22.

It is seen that the DC flux path extends through the diaphragm 24 and the armature 12 where it interacts with a flux path, normally denoted the AC flux path, generated by the coil 18. The AC flux path also is a closed flux path extending in the armature 12 and diaphragm 24 and exits these elements to enter the magnetically-permeable housing portion 34 extending the full length of the receiver 10 and in parallel to the armature 12 and diaphragm 24.

Figure 3:
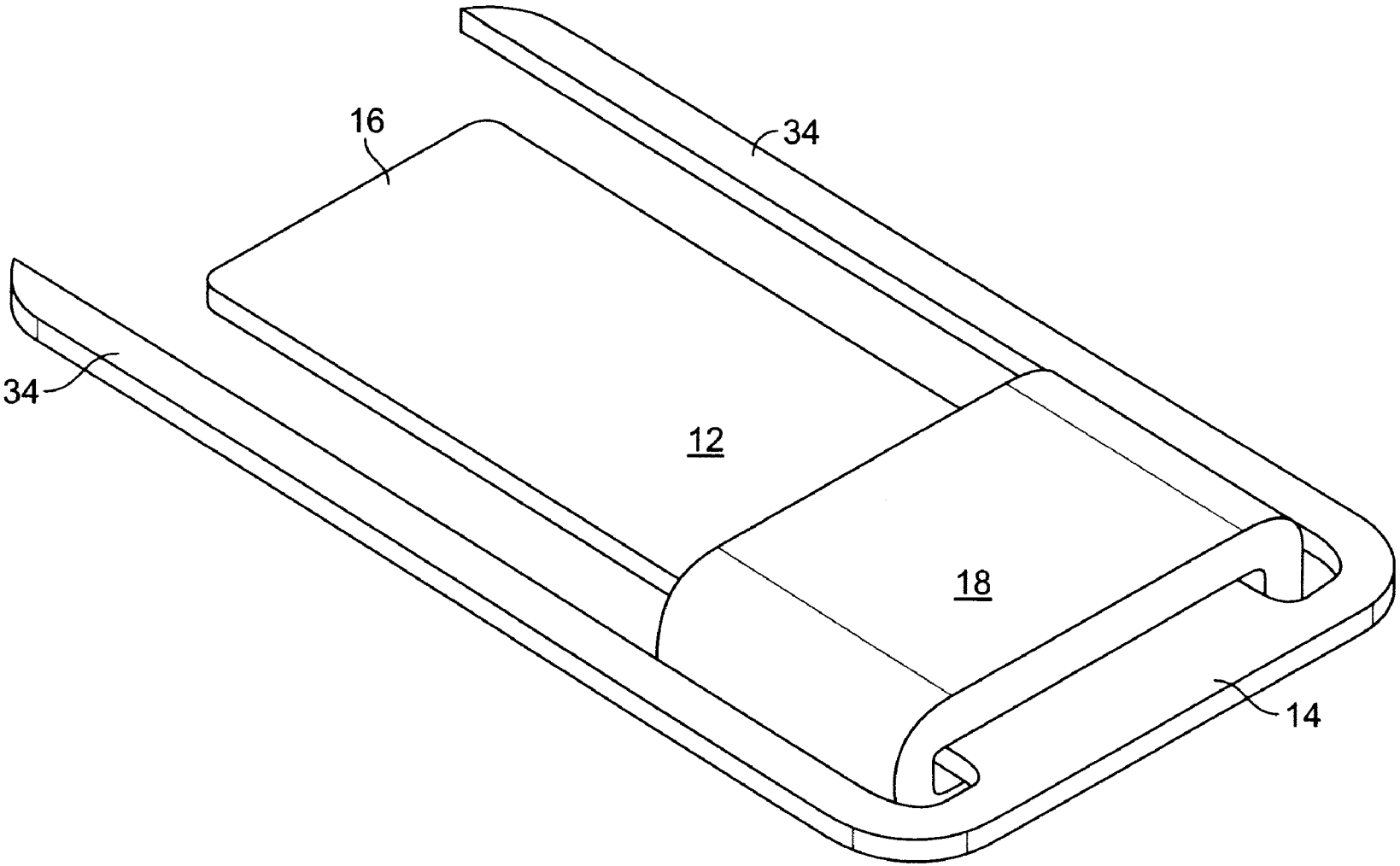
FIG. 3 illustrates a second sub-assembly of the receiver of FIG. 1.

FIG. 3 illustrates a sub-assembly of the receiver 10 wherein it is seen that the armature 12 may be made of the same piece of material as the housing portions 34, whereby the optimal magnetic connection/conduction is provided between these parts. This also reduces the parasitic coupling in that the magnetic permeability between these parts is optimized.

Especially when desiring to provide miniaturized receivers, parasitic losses will occur due to flux paths occurring which remove flux from the positions, such as the air gap, where it is desired. Such parasitic paths reduce the efficiency of the receiver 10.

In the present type of receiver 10, a parasitic flux path is seen between the permanent magnets 20, 22 via the housing to the coil 18. Such a flux path will have flux from the magnet 20 travelling not inside the air gap to the magnet 22, but to the armature 12/diaphragm 24 to the coil 18 and back to the magnet via the housing.

Another parasitic flux path may be that from inside the coil 18 via the armature 12, the housing portion 36 (if it was magnetically permeable; see below) and back into the coil 18.

In order to remove these flux paths, the upper housing portion 36 is made of a magnetically non-permeable or non-conducting material. In this manner, the only flux path from the permanent magnets 20, 22 to the coil 18 is via the magnetically permeable housing portion(s) 34 extending along the length of the receiver 10. However, this parasitic flux path is quite small in that the dimensional overlap between the housing portions 34 and the coil 18 is vastly reduced compared to the overlap between the housing portions 36 and the coil 18. In addition, AC flux from the coil 18 must then travel via the armature 12, the housing portion(s) 34 and back to the fixed end 14 of the armature.

In order to further increase the active flux paths, the housing portion(s) 32 preferably extend(s) only, in the direction toward the end 14, to the end portion of the permanent magnets 20, 22. Also, it is desired that the armature 12 is not wider than the extent of the permanent magnets 20, 22 in the direction perpendicular to the longitudinal axis of the receiver 10 in order to reduce any flux travelling from the armature 12 to the housing portions 32 but outside the permanent magnets 20, 22.

In the AC flux path, the flux from the armature 12/diaphragm 24 will travel from the edges thereof and to the housing portion 34 or the end element 37 of the receiver 10 and thereby back to the far end part 35 of the receiver in order to enter the fixed end 14 of the armature 12 and close the flux path. Flux may also flow from the armature 12 through the diaphragm 24 and the elements 28 to the end element 37 or housing portion 34. This flux path is equally useful.

The AC flux path generally lies in a plane parallel to that of the diaphragm 24, whereas the DC flux path generally lies in a plane perpendicular to the plane of the diaphragm 24.

Thus, both flux paths are closed and optimized and will ensure that as much of the flux as possible is brought to the positions where it is desired, while parasitic flux paths are reduced and removed.

In a presently preferred embodiment, the diaphragm 24 is made of a 2 μm thick sheet of PET which may be coated by a magnetically permeable material, such as Ni. In addition, the armature 12 may be 0.1 mm thick and the part 37 may be 0.32 mm thick, and both may be made of 50% Fe and 50% Ni, as may the housing parts and the part 37. The housing part 34, as well as the sealing member 28, may be made of brass (63% Cu and 37% Zn).

The magnets may be AlNiCo magnets with a thickness of 0.25 mm, and the coil 18 may have 550 windings of a 20 μm self-bonding wire.

Figure 4:
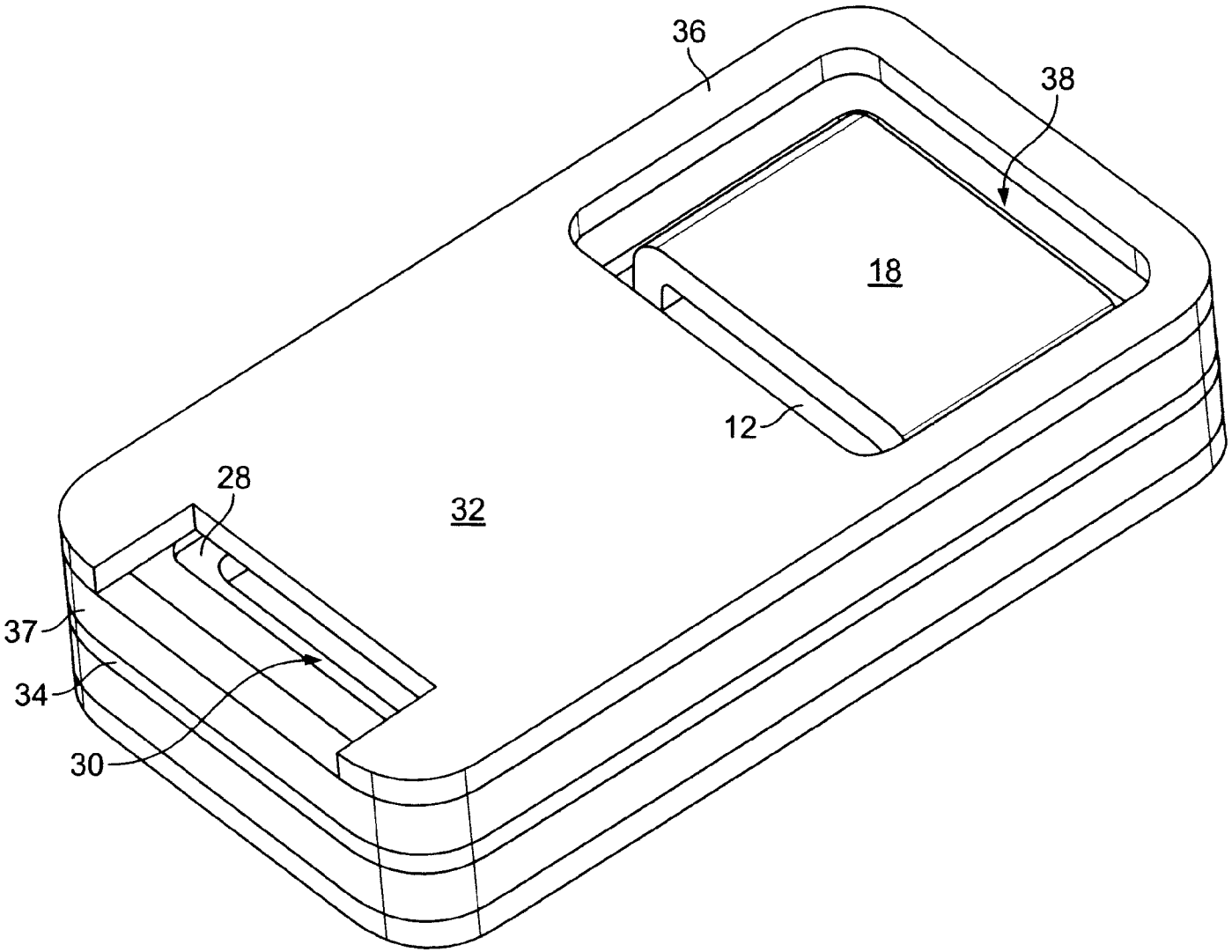
FIG. 4 illustrates an alternative method of providing a reduced parasitic coupling between the housing and the coil.

FIG. 4 illustrates an alternative manner of reducing the parasitic flux path between the coil 18 and the housing in that the housing portions 32, 36 now are made of a single piece of material, but where an opening 38 is provided in the housing portion 36. The opening 38 may be filled with a material with a lower magnetic permeability, or it may be open. In the latter situation, it may be desired to provide an outer housing or the like (such as a rubber tube or sock normally used for holding and shielding receivers in hearing aids) in order to prevent sound output from the opening 38 to mix with sound output from the sound output 30.

An alternative to the opening 38 may be the providing of a number of openings in the housing portion 36. Again, these openings may or may not be filled with a material having a lower magnetic permeability. Also, instead of openings, a reduced thickness of the material of the housing portion 36 may be used for reducing the parasitic coupling between the coil 18 and that part of the housing. If the thickness is reduced to a degree where the stability or strength of the housing is unsuitable, the housing may at that position be reinforced using a material of a lower magnetic permeability such as filling any indentations in the material of the housing.

An alternative to the providing of the opening(s) or reduced thickness portion(s) directly adjacent (such as above) the coil 18, these may be provided evenly distributed over the full area of the housing portion 36 or may be provided at a peripheral part thereof, where a central portion thereof may than have any desired magnetic permeability in that this area is "magnetically isolated" from, for example, the housing portion 32 by these peripheral parts.

Naturally, the attached diaphragm 24 and armature 12 may be replaced by a single element which has the width desired of the diaphragm in order to generate the desired sound pressure and in order to enable sealing the front chamber from the back chamber. This sealing may be provided in the same manner as illustrated in FIG. 2 or may be provided at the sides of the diaphragm/armature and to the inner surfaces of the receiver 10 housing. In this situation, the material of the armature/diaphragm normally will be relatively stiff, whereby the resiliency desired to take up the movement thereof may be provided by the sealing material.

In order to obtain a balanced setup, the two permanent magnets 20, 22 have been provided on either side of the diaphragm assembly. One of these permanent magnets 20, 22 may, however, be replaced or removed in order to utilize only a single magnet (i.e., one of 20, 22) for generating the DC flux.

It is seen that the present receiver 10 may be made extremely small while maintaining the useful flux paths and reducing or suppressing the parasitic flux paths. In fact, the thickness of the receiver 10 is determined by the thickness of the housing parts 32, the magnets 20, 22 as well as the size of the air gap there between. In addition, a flat, wide coil 18 may be used which may be used inside this thin housing.

The present receiver 10 may be as thin as 1 mm or thinner, and the width thereof may be 2.7 mm or narrower.

In various aspects, the magnet assembly described herein may comprise one or more magnets positioned together or at different positions in the receiver 10 while all participating in generating the magnetic field provided in the air gap. Likewise, in various aspects, the coil 18 may comprise one or more coils defining the coil tunnel. In other aspects, the armature 12 may comprise one or more parts, one or more of which may be magnetically permeable. Preferably, a part thereof extending both through the air gap and the coil tunnel is magnetically permeable in order to conduct the magnetic field from the coil tunnel to the air gap.

In this context, a flux path is generated, a flux path being the path which the flux of a magnet (or a number of magnets) takes from one pole of a magnet to the other pole of that magnet. Naturally, more magnets may be part of a flux path, where flux runs from one pole of one magnet to a pole of the other magnet, etc. All flux paths are closed in that flux lines cannot be open. Flux runs through all materials, if need be, but as in relation to electrical signals, good conductors are preferred/used, if such are present and available.

Normally, the first and second chambers 29, 31 of the receiver 10 are acoustically sealed from each other so that sound waves within predetermined intervals are prevented from travelling from one chamber to the other. Naturally, a so-called DC vent may be provided for providing pressure relief caused by, for example, travelling in an elevator whereby the external air pressure changes.

The suspension element (e.g., side portions 26) is resilient and preferably provides a sealing between edges or circumferential parts of the diaphragm element and an internal surface of the housing in order to be able to adapt to the movements of the diaphragm element during generation of sound while providing the sealing. It is clear that the diaphragm element 24 may be made integral with, such as made of the same material or even made monolithically with, the material of the armature assembly 12. In addition, or alternatively thereto, the diaphragm element 24 may be made integral with, such as made of the same material or even monolithically with the suspension element.

Alternatively or in addition, the suspension element (e.g., side portions 26) may be made of or comprise a film, such as a bent film, an elastomer, a rubber material, a foam, or the like. In general, the stiffness of the suspension element (the force required to move the diaphragm assembly when controlled or held only by the suspension element) is 500 N/m or less, such as 400 N/m or less, preferably 300 N/m or less, such as 200 N/m or less, such as 100 N/m or less.

The various elements disclosed herein however shaped or provided, may be attached to each other by any suitable manner, such as gluing, soldering, welding, heat welding, laser welding, mechanical attachment, or the like.

In a first embodiment, the diaphragm element 24 and the suspension element 26 comprises a film, such as a magnetically non-conducting film coated with a magnetically permeable substance, the diaphragm element being at least partly formed by an at least substantially plane central part of the film, and the suspension element being at least partly formed by one or more peripheral, bent or curved parts of the film. This plane part of the film is suitable as a known diaphragm, and the bent or curved parts of the film may extend in directions where the bending/curves are adapted to take up the movement (such as by stretching or altering the bent/curved shape) of the diaphragm element. These bends/curves then define, with the stiffness of the material of the film, the compliance of the suspension provided by the bent/curved film parts.

In general, the compliance or stiffness of the armature assembly 12 will relate to the resonance frequency and other parameters of the receiver 10 in that the stiffness or resiliency of the armature 12 is part of the driver of the receiver. The stiffness of this assembly is defined both by the material and the dimensions of the assembly. According to the invention, the stiffness of this assembly is 600 N/m or more, but preferably, it is in the interval of 650-5000 N/m, when measured at the force point (the point of the armature 12 at which the mean force (size and direction) of the magnet assembly acts) of the armature assembly. This position often is the center of the magnets in a cross-section along the plane of the diaphragm element 24.

In preferred embodiments, the armature assembly alone or attached to the diaphragm element has a resonance frequency of 1 kHz-10 kHz, such as 3 kHz-5 kHz when moving freely, such as when the magnet assembly has been removed or demagnetized. The lower frequency level may be suitable for woofers and the higher for tweeters.

The resonance can be easily measured by, for example, a set up where holes are made in the receiver 10 so that the back and front volume do not add stiffness. Also, the magnet assembly may be removed so that the receiver 10 is not magnetized, then no stiffness compensation is required due to magnetization from the magnet assembly. It is also possible to measure the resonance with the magnets present, but preferably where these are demagnetized.

Then, it is possible to measure the resonance of the armature/membrane assembly by shaking/vibrating the receiver 10. The shaker/vibrator is driven with a frequency sweep from 100 Hz to 10 kHz. A laser vibrometer may then used to measure the velocity of the armature assembly with the optional diaphragm element. The receiver 10 will move along with the frequency of the shaker/vibrator, and at the resonance of the armature assembly will have a sharp peak at the resonance frequency where the velocity of the armature assembly is the highest.

In a second embodiment, the armature assembly has a part forming at least part of the diaphragm element, extending in the air gap, and having a predetermined width, the suspension element being provided at peripheral portions of the part of the part of the armature assembly.

Preferably, the suspension element provides an acoustical seal between peripheral portions of the diaphragm element and an inner surface of the housing. Preferably, the diaphragm element defines a first plane. Then, in a first embodiment, the suspension element forms a seal between peripheral portions of the diaphragm element and parts of the inner surface of the housing at least substantially in the first plane. This is desirable in certain embodiments where a large first chamber is desired. In another embodiment, the suspension element forms a seal between peripheral portions of the diaphragm element and parts of the inner surface of the housing extending at least substantially parallel to the first plane. In this manner, a cup-shaped, ring-shaped, or donut-shaped suspension element may be used which may also form all of or part of the diaphragm element.

Preferably, the armature assembly is hingedly or bendably fixed at an end positioned at one end of the coil tunnel, the air gap being positioned at another end of the coil tunnel. Thus, the part of the armature assembly at the air gap is positioned at a distance from the fixed end and will therefore be allowed to move and thereby provide the sound pressure sought for when transferring the movement to the diaphragm element.

In certain embodiments, it is preferred that the magnet assembly comprises a permanent magnet positioned in the first chamber. In that manner, the receiver 10 may be quite small. An additional magnet may be positioned in the second chamber in order to provide a so-called balanced receiver.

In general, receivers incorporating the present invention may be made quite small. Thus, the housing may have a largest dimension, perpendicular to a plane defined by the diaphragm element, of no more than 1.9 mm (e.g., no more than 1.5 mm) and, preferably, no more than 1 mm (e.g., no more than 0.8 mm).

In addition, the housing may, in a plane perpendicular to the first direction, have a width in a plane defined by the diaphragm element and a thickness perpendicular thereto, the width being between 1 and 10 times the thickness, such as between 1 and 5 times the thickness, such as between 2.4 and 4 times the thickness.

Preferably, a first closed magnetic flux path exists in the receiver 10, the first flux path comprising a first magnetically permeable housing portion, the permanent magnet assembly, the air gap, and the magnetically permeable armature assembly.

Also, it is preferred that a second closed magnetic flux path exists comprising a second magnetically permeable housing portion, extending at least substantially in the first direction, the magnetically permeable armature assembly and extending through the coil tunnel. This flux path, normally denoted the AC flux path, is that which varies due to the signal provided to the coil, and which is extended, by the armature assembly, to the air gap, where the armature assembly and the diaphragm element is vibrated. The second housing portion is provided in order to optimize this flux so as to increase the efficiency of the receiver 10.

Each of these embodiments and obvious variations thereof is contemplated as falling within the spirit and scope of the claimed invention, which is set forth in the following claims.

What is claimed is:

1. A receiver comprising a housing having therein:

a permanent magnet assembly generating a magnetic field in an air gap, an electrically conductive drive coil comprising a coil tunnel, a sound output, a magnetically permeable armature assembly extending in a first direction through the air gap and the coil tunnel, a suspension element having a stiffness of at the most 500 N/m, and a diaphragm element for producing sound, extending in the air gap, and being operatively attached to the suspension element, wherein the housing has a first and a second chamber defined at least by opposite sides of the diaphragm element and the suspension element and wherein the sound output extends between the first chamber and the surroundings of the receiver.

2. A receiver according to claim 1, wherein the armature assembly has a stiffness of at least 600N/m.

3. A receiver according to claim 1, wherein the suspension element provides a sealing between edges or circumferential parts of the diaphragm element and an internal surface of the housing.

4. A receiver according to claim 1, wherein the diaphragm element and the suspension element comprises a film, the diaphragm element being formed at least partly by an at least substantially planar central part of the film, and the suspension element being formed at least partly by one or more peripheral, bent or curved parts of the film.

5. A receiver according to claim 4, wherein the first portion of the armature assembly is fixed to the central part of the film.

6. A receiver according to claim 1, wherein the armature assembly has a part forming at least part of the diaphragm element, extending in the air gap, and having a predetermined width, the suspension element being provided at peripheral portions of the part of the armature assembly.

7. A receiver according to claim 1, wherein the armature assembly is hingedly or bendably fixed at an end positioned at one end of the coil tunnel, the air gap being positioned at another end of the coil tunnel.

8. A receiver according to claim 1, wherein the magnet assembly comprises a permanent magnet positioned in the first chamber.

9. A receiver according to claim 1, wherein the suspension element provides an acoustical seal between peripheral portions of the diaphragm element and an inner surface of the housing.

10. A receiver according to claim 1, wherein the diaphragm element defines a first plane, and wherein the suspension element forms a seal between peripheral portions of the diaphragm and parts of the inner surface of the housing at least substantially in the first plane.

11. A receiver according to claim 1, wherein the diaphragm element defines a first plane, and wherein the suspension element forms a seal between peripheral portions of the diaphragm and parts of the inner surface of the housing extending at least substantially parallel to the first plane.

12. A receiver according to claim 1, wherein the housing has a largest dimension, perpendicular to a plane defined by the diaphragm assembly, of no more than 1.9 mm.

13. A receiver according to claim 1, wherein the housing, in a plane perpendicular to the first direction, has a width in a plane defined by the diaphragm assembly and a thickness perpendicular thereto, the width being between 1 and 10 times the thickness.

* * * * *